United States Patent [19]

Ohno

[11] 4,396,899

[45] Aug. 2, 1983

[54] PLATINUM THIN FILM RESISTANCE ELEMENT AND PRODUCTION METHOD THEREFOR

[75] Inventor: Yoshio Ohno, Zama, Japan

[73] Assignee: Kabushiki Kaisha Kirk, Tokyo, Japan

[21] Appl. No.: 248,179

[22] Filed: Mar. 30, 1981

[30] Foreign Application Priority Data

| | | | |
|---|---|---|---|
| Apr. 16, 1980 | [JP] | Japan | 55/049205 |
| Apr. 16, 1980 | [JP] | Japan | 55/049206 |
| Apr. 16, 1980 | [JP] | Japan | 55/049207 |
| Apr. 16, 1980 | [JP] | Japan | 55/049208 |
| Dec. 17, 1980 | [JP] | Japan | 55/177220 |

[51] Int. Cl.[3] ..... H01C 1/012

[52] U.S. Cl. ..... 338/34; 338/308; 338/22 SD; 338/195; 204/192 F; 73/27 R

[58] Field of Search ..... 338/34, 35, 308, 309, 338/314, 272, 274, 28, 25, 22, 300, 302, 275, 261, 195; 73/27 R; 422/98; 204/192 F

[56] References Cited

U.S. PATENT DOCUMENTS

| | | | |
|---|---|---|---|
| 2,357,473 | 6/1941 | Jira | 338/262 |
| 3,699,803 | 10/1972 | Sumi et al. | 338/34 |

OTHER PUBLICATIONS

Okuma et al., "Newly-Developed LP-Gas Sensor", *Toshiba Review*, No. 118, (Nov.-Dec. 1978), pp. 31-33.

*Primary Examiner*—B. A. Reynolds
*Assistant Examiner*—Catherine Sigda
*Attorney, Agent, or Firm*—Pollock, Vande Sande & Priddy

[57] ABSTRACT

A platinum thin film is formed by sputtering platinum onto an insulating substrate and heat aging the platinum thin film in a stairstep manner. A kerf is formed in the platinum thin film to produce a desired resistance, and a metal oxide semiconductor film is thereafter deposited on the platinum thin film to produce a gas sensor.

10 Claims, 21 Drawing Figures

ELECTRON MICROSCOPIC PHOTOGRAPH OF HEAT-AGED Pt FILM OF ABOUT 200Å SPUTTERED ON A LAPPED ALUMINA SUBSTRATE (x28000)

ELECTRON MICROSCOPIC PHOTOGRAPH OF HEAT-AGED Pt FILM OF ABOUT 200Å SPUTTERED ON A FUSED QUARTZ SUBSTRATE (x28000)

PLATINUM THIN FILM RESISTANCE ELEMENT AND PRODUCTION METHOD THEREFOR

BACKGROUND OF THE INVENTION

The present invention relates to a platinum thin film resistance element for use in a temperature sensor and a gas sensor and a method for the manufacture of such a platinum thin film resistance element.

As a resistance thermometer for use in temperature sensors, there has heretofore been employed a platinum winding resistance element or negative temperature coefficient temperature sensitive resistance element (for example, a thermistor). These elements, however, have the following defects:

Main defects of platinum winding resistance element:

(1) Since its impedance is usually as small as 50 or 100Ω, the output sensitivity is low.

(2) It is susceptible to mechanical vibration or shock; namely, since a platinum wire is wound on a glass rod, the platinum wire is likely to slip off from the glass rod due to vibrations.

(3) Since the resistance value is small, a three-core or four-core lead wire is needed for avoiding the influence of a lead wire.

Main defects of thermistor:

(1) Compatibility is poor because of difficulty in the production of thermistors of the same characteristics.

(2) Characteristic variations with time are substantial.

(3) The temperature-resistance characteristic is negative and exponential rather than linear.

Gas sensors employing such conventional resistance elements have the following defects:

A sensor using a platinum wire coil is called a hot-wire gas sensor. A catalyst is laid on the platinum wire coil and, upon arrival of a gas, the catalyst promotes its combustion to cause a change in the resistance value of the platinum winding, and this resistance variation is detected.

(1) Because of the winding, its resistance value cannot be increased. Therefore, a voltage of a bridge circuit for detecting the resistance variation is as low as 2 V or so on an average and the gas sensitivity is also poor; it is impossible to detect a low concentration of a gas the molecular heat of combustion of which is low, such as carbon monoxide.

(2) Since it is necessary that the platinum wire be wound into uniform coils, with their catalyst coated surfaces held in the same condition, the productivity is poor and the mechanical strength is low.

A sensor using a thermistor is called a gas thermal conductivity system. This makes use of a difference in thermal conductivity between air and a gas to be sensed and requires two thermistors of the same characteristics.

(1) It is difficult to select two thermistors of the same characteritics.

(2) The balance between the two thermistors is lost owing to characteristic variations with time.

(3) The output is not linearly proportional to the gas concentration.

A sensor using a metal oxide is called a semiconductor sensor and is intended to directly read out a resistance variation which is caused by the adsorption of a gas to a metal oxide such as $SnO_2$, ZnO, $V_2O_5$ or the like. This sensor also has the following drawbacks:

(1) Much time is required until it becomes stable after the connection of the power source.

(2) The zero point is very unstable even in the absence of the gas to be sensed.

(3) The low-concentration sensitivity is good but an output change with a concentration change at a high concentration is very small.

(4) Reproducibility is very poor and hence reliability is low.

Heretofore, there has not been put to practical use a gas sensor which is capable of accurately detecting carbon monoxide even at such a low concentration as 50 PPM without being affected by other gases.

Similarly, there has not been available a highly stable and sensitive sensor for detecting a nitrogen oxide, in particular, nitrogen monoxide. Further, there have not been proposed a sensor capable of stably detecting only ammonia even at a low concentration or a sensor capable of stably detecting only an inflammable gas.

A conventional platinum resistance element has employed a winding resistor and it has been said that a thin film resistance element could not be produced. That is, even if a platinum thin film is deposited by sputtering on an insulating substrate as is the case with the fabrication of the conventional thin film resistance element, the platinum thin film is not held stably and disappears during heat aging.

It is an object of the present invention to provide a platinum thin film resistance element the resistance value of which can easily be made large and which does not require a three-core or four-core lead wire but is stable.

Another object of the present invention is to provide a method for the manufacture of a stable platinum thin film resistance element.

Another object of the present invention is to provide a stable and reliable platinum thin film resistance element capable of accurately detecting a gas to be detected.

Another object of the present invention is to provide a platinum thin film resistance element which is capable of accurately detecting carbon monoxide of low concentration.

Another object of the present invention is to provide a platinum thin film resistance which is capable of stably detecting a nitrogen oxide.

Another object of the present invention is to provide a platinum thin film resistance element which is capable of detecting an ammonia gas even at a low concentration.

Yet another object of the present invention is to provide a platinum thin film resistance element which is capable of stably detecting an inflammable gas alone.

SUMMARY OF THE INVENTION

According to the present invention, a platinum thin film is deposited on the surface of an insulating substrate of, for example, a cylindrical or columnar configuration, and a pair of lead wires are electrically connected to both end portions of the platinum thin film and fixed to the insulating substrate. The platinum thin film is deposited by sputtering to a thickness of, for example, about 200 to 1000 Å. The insulating substrate is required to have a smooth surface and stand heat aging at 1000° C. The power for the sputtering is selected to be 0.8 $W/cm^2$ or more so as to ensure the adhesion of the platinum thin film to the insulating substrate. The platinum thin film thus deposited on the insulating substrate is stabilized by heat aging, raising temperature from about 100° C. up to around 1000° C. in a stepwise manner. Thereafter, a spiral kerf is formed in the platinum thin film to obtain thereacross a required resistance value. The abovesaid lead wires are attached to both end portions of the platinum thin film. In the case of obtaining a mere temperature sensor, the platinum thin film is covered with a protective film of an insulating paint of the polyimid or silicon system.

In this way, a stable platinum thin film resistance element is obtained which has a resistance value of several tens of ohms to scores of kilo-ohms. The platinum thin film resistance element thus obtained is combined, as a temperature sensor, with a resistance element having no temperature coefficient to form a bridge circuit, by which temperature can be measured with high accuracy. Further, a temperature sensor free from the influence of the lead wires can be obtained with a simple construction.

By forming on the platinum thin film a metal oxide semiconductor film capable of adsorbing and releasing a gas to be sensed and selecting the resistance value of the metal oxide semiconductor film to be sufficiently larger than the resistance value of the platinum thin film, it is possible to obtain a platinum thin film resistance element which is capable of gas detection with a linear and hence reproducible detection sensitivity characteristic. Further, by forming a thin film of the copper oxide system on the platinum thin film, a platinum thin film resistance element capable of accurately detecting carbon monoxide even at a low concentration can be obtained. Moreover, a platinum thin film resistance element capable of detecting a nitrogen oxide can be produced by forming on the platinum thin film a film of a mixture including 10 to 30 wt% of rare earth oxide and 0.5 to 5 wt% of silver nitrate with respect to vanadium pentoxide. Also it is possible to obtain a platinum thin film resistance element capable of detecting ammonia by forming on the platinum thin film a film of a mixture including 3 to 10 wt% of rare earth oxide, 1 to 5 wt% of antimony trioxide and 0.5 to 5 wt% of silver nitrate with respect to vanadium pentoxide.

When such a metal oxide film is thus formed on the platinum thin film, a protective layer as of alumina cement or beryllia cement is interposed therebetween, by which it is possible to obtain a gas sensor which detects only a specified gas and has small characteristic variations with time. Further, in the case of using the platinum thin film resistance element for gas detection, heating means is provided in the element for improving its sensitivity. That is, a coiled nichrome wire heater is housed, for example, in a tubular insulating substrate and a current is applied to the heater to heat the platinum thin film resistance element up to a proper temperature.

DESCRIPTION OF THE PREFERRED EMBODIMENTS

Figure 1A:
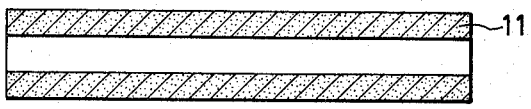
FIGS. 1A to 1F are explanatory of a manufacturing method of a platinum thin film resistance element according to the present invention, FIGS. 1A, 1B and 1D being sectional views and FIGS. 1C, 1E and 1F being front views.
Figure 1B:
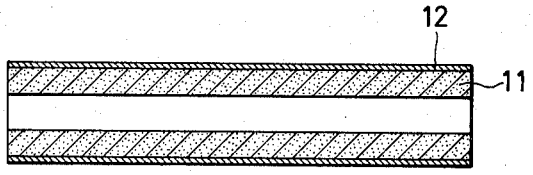
Figure 1C:
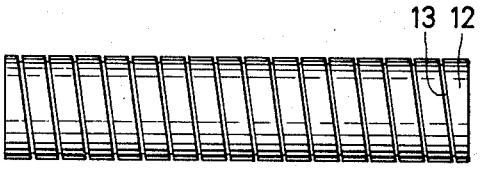

In the present invention, a platinum thin film is deposited on an insulating substrate of a smooth surface, which is formed by transparent fused quartz, hard glass capable of standing temperatures higher than 1000° C. or porcelain. The unevenness of the surface of the insulating substrate, if any, is made smaller than the thickness of the platinum film to be formed thereon. As the insulating substrate, use is made of a cylindrical insulating substrate 11 as shown in FIG. 1A. After being sufficiently washed and dried, the insulating substrate 11 is heated at 1000° C. or so in a furnace so that adsorbed gases and water are completely released from the substrate 11. Then, the insulating substrate 11 is put in a sputtering equipment, wherein it is subjected to sputtering of platinum while being rotated about its axis by means of a rotating jig, by which a platinum thin film 12 is deposited uniformly all over the outer peripheral surface of the insulating substrate 11, as shown in FIG. 1B. The platinum thin film 12 has a purity of 99.999% or more. For the above sputtering, a sputtering equipment can be employed and the sputtering condition is such that when a platinum target and the insulating substrate 11 are spaced 1 cm apart, use is made of an ionic current of 10 mA or more with 1.4 KV, that is, the sputtering power of 0.7 W/cm$^2$, preferably, 0.8 W/cm$^2$ or more. The sputtering time depends on the thickness of the platinum thin film 12 desired to obtain; usually, the sputtering is carried out for approximately an hour to an hour and a half.

The platinum thin film thus formed by sputtering is unstable if it is left untreated. The insulating substrate 11 deposited with the platinum thin film 12 is accordingly subjected to heat aging in an electric furnace, in which it is heated up to 1000° C. raising the temperature, for example, from 100° C. by steps of 100° C. at one-hour intervals.

After the heat aging, a spiral-shaped kerf 13 is cut by a diamond cutter or laser cutter in the platinum thin film 12 to increase its resistance value. The pitch of the kerf 13 is dependent on the resistance value desired to obtain. By the formation of the kerf 13 the resistance value can be raised on the order of 1000 times. From the viewpoint of increasing the resistance value by the formation of the kerf 13, it is preferred that the thickness of the platinum thin film 12 be at least about 100 Å or more. Too large a thickness of the platinum thin film 12 takes much time for sputtering which lowers productivity and increases the amount of platinum used, and hence is not preferred from the economical point of view. Further, for raising the resistance value, too, it is desirable that the thickness of the platinum thin film 12 not be too large; it is considered that a maximum thickness is approximately 1000 Å.

Figure 1D:
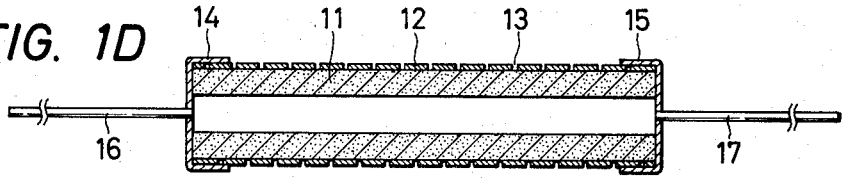
Figure 1E:
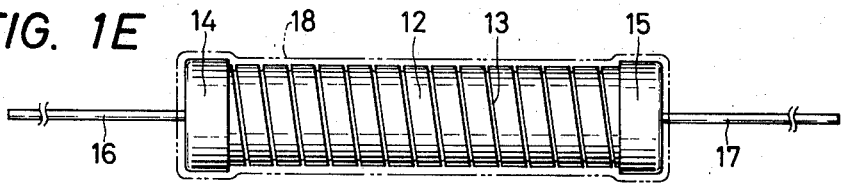

Following the formation of the kerf 13, lead wires are connected to both ends of the platinum thin film 12. For example, as depicted in FIG. 1D, caps 14 and 15 of a corrosion resisting metal such as stainless steel are press-fitted and fixed onto the marginal portions of the platinum thin film 12 on both end portions of the cylindrical insulating substrate 11. Then, heatproof lead wires 16 and 17, each produced, for example, by plating an iron wire with copper and then nickel, are connected at one end, as by spot welding, to the centers of the outer end faces of the caps 14 and 15, respectively, through which the lead wires 16 and 17 are electrically connected to the platinum thin film 12. As illustrated in FIG. 1E, a protective film 18 is formed to a thickness of about 10 to 15 μm all over the platinum film 12 and the caps 14 and 15 by baking thereon a heat-resisting wet-proof, insulating resin paint as of the polyimid or silicon system.

Figure 1F:
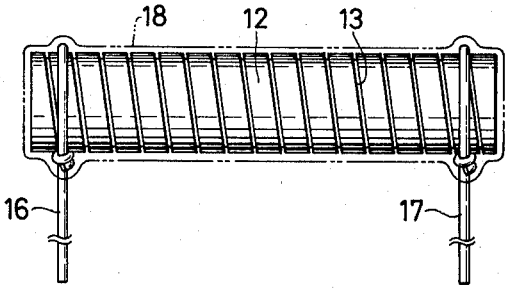

The lead wires 16 and 17 may be attached, for instance, in the manner shown in FIG. 1F, too, in which the lead wires 16 and 17 of platinum are wound on the platinum thin film 12 on both end portions of the insulating substrate 11 and then a platinum paste is baked thereon to connect the lead wires 16 and 17 to the platinum thin film 12 and fix them to the insulating substrate 11.

In the sputtering of platinum, when the sputtering power was smaller than 0.7 W/cm$^2$, for example, 0.53 W/cm$^2$ with an ionic current of 8 mA and a voltage of 1.4 KV, platinum particles were not firmly deposited by sputtering on the insulating substrate. As compared with the case of an 11 mA ionic current, the quantity of gas adsorbed to the platinum particles was large to make the platinum film sparse and thick, containing many pores around the platinum particles, and the resistance value was as large as 70 to 80Ω (in the case of the 11 mA ionic current, 20 to 30Ω). And in the course of heat aging, the platinum particles were dispersed together with the adsorbed gas, resulting in the resistance value becoming 200Ω to infinity. In the case where the ionic current was 11 mA, however, the adsorbed gas in the platinum thin film was released by the heat aging and the platinum thin film became a thin, continuous or solid film with a resistance value of 1.7 to 2.0Ω. As will be appreciated from the above, the platinum thin film 12 cannot be formed with the sputtering power of less than 0.70 W/cm$^2$.

The platinum thin film deposited by sputtering on the insulating substrate is an assembly of platinum particles that contains gas, the gas being released by the heat aging from the platinum thin film to make it a continuous, solid film. Shown in the following are variations in the resistance value and temperature coefficient of the platinum thin film during the heat aging in the case of sputtering platinum on the outer peripheral surface of an insulating substrate 2.5 mm in diameter and 7 mm long using a voltage of 1.4 KV and an ionic current of 11 mA.

| | Resistance value | Temperature coefficient |
|---|---|---|
| Immediatedly after sputtering | 24 Ω | 2260 PPM |
| 100° C. an hour | 24 Ω | 2370 PPM |
| 100 to 400° C. (raised by steps of 100° C. at 1-hour intervals) | 16 Ω | 2700 PPM |
| 100 to 600° C. (raised by steps of 100° C. at 1-hour intervals) | 6 Ω | 2860 PPM |
| 100 to 800° C. (raised by steps of 100° C. at 1-hour intervals) | 2.0 Ω | 3660 PPM |
| 100 to 1000° C. (raised by steps of 100° C. at 1-hour intervals) | 2.0 Ω | 3680 PPM |

As is evident from the above, when the heat aging is carried out up to 800° C. raising the heating temperature by steps of 100° C. at one-hour intervals, the resistance value becomes constant and, in this respect, such heat aging is satisfactory; in terms of the temperature coefficient, however, it is preferred that the heat aging be conducted up to 1000° C.

For testing the stability of the resistance value of the platinum thin film 12, samples were produced by heat-aging platinum thin films of the same lot through various methods, attaching the caps 14 and 15 and the lead wires 16 and 17, forming the spiral kerf 13 to provide a resistance value of about 1000Ω and then forming the protective film 18. The samples were each subjected to a temperature cycle test for 30 minutes at −50° to 200° C. five times and their resistance values at 0° C. were measured before and after the tests to check the stability of the resistance value.

| Heat aging method | Result of stability test | Dispersion in temperature coefficient |
|---|---|---|
| ① 100 to 1000° C. (raised by steps of 100° C. at 40-minute intervals) | −0.3% | ±0.6% |
| ② 100 to 1000° C. (raised by steps of 100° C. at 1-hour intervals) | −0.01% | ±0.3% |
| ③ 100 to 1000° C. (raised by steps of 100° C. at 1.5-hour intervals) | −0.01% | ±0.2% |
| ④ 100 to 1000° C. (raised by steps of 100° C. at 2-hour intervals) | −0.01% | ±0.2% |
| ⑤ 200 to 800° C. (raised by steps of 200° C. at 2-hour intervals) | −0.7% | ±1.0% |
| 200 to 1000° C. | −0.4% | ±1.0% |

-continued

| Heat aging method | Result of stability test | Dispersion in temperature coefficient |
|---|---|---|
| ⑥ (raised at steps of 200° C. by 2-hour intervals) 400 to 800° C. | −0.8% | ±2.3% |
| ⑦ (raised by steps of 100° C. at 2-hour intervals) 400 to 1000° C. | −0.5% | ±1.8% |
| ⑧ (raised by steps of 100° C. at 1-hour intervals) | | - |

The above indicates that the aging methods ②, ③ and ④ provide a high degree of stability in the resistance value and hence are preferred.

Figure 2A:
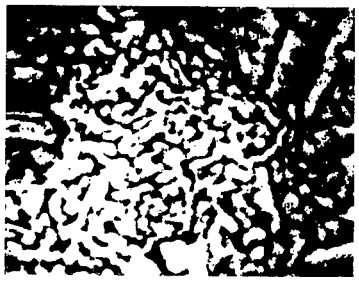
FIG. 2A is an enlarged diagram showing a platinum thin film formed on an alumina substrate.
Figure 2B:
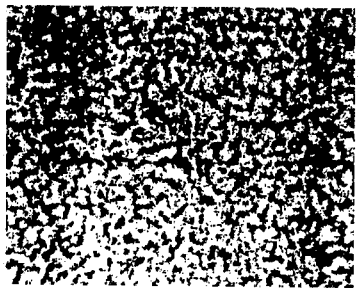
FIG. 2B is an enlarged diagram showing a platinum thin film formed on a transparent fused quartz substrate.

As referred to previously, it is preferred that the platinum thin film be about 100 to 1000 Å (0.01 to 0.1μm) thick; therefore, the unevenness of the surface of the insulating substrate 11 is held less than 1.1 μm. For example, in the case of an alumina substrate, crystals of alumina are several μ meters in size and even if lapped, the surface of the alumina substrate still has an unevenness of 0.5 μm or so. FIG. 2A is a photo-micrograph of a platinum thin film formed on such an alumina substrate and heat-aged. FIG. 2B is a photo-micrograph of a platinum thin film deposited on a transparent fused quartz substrate and heat-aged. It appears from FIG. 2B that the platinum thin film is formed uniformly as compared with the thin film shown in FIG. 2A. The platinum thin films were about 200 Å in either case.

The platinum thin film resistance element obtained as described in the foregoing is stable chemically and exhibits a positive linear temperature-resistance characteristic and, in addition, it can be set by a suitable selection of the pitch of the kerf 13 to a resistance value, for example ranging from several tens of ohms to scores of kilo-ohms. By setting such a high resistance value, the accuracy of temperature measurement can be enhanced and the resistances of the lead wires can be neglected; accordingly, no compensation is needed for the lead-wire resistances, permitting simplification of the measuring circuit arrangement. Moreover, since the platinum thin film 12 is deposited on the insulating substrate 11, there is no likelihood that the film slips out of position due to mechanical vibration and shock unlike a winding wrapped around an insulating substrate as in the prior art; furthermore, the deposition of the platinum thin film on the insulating substrate is better for mass-production purposes than the winding of a thin platinum wire on the insulating body and allows ease in the production of resistance elements free from dispersion in the resistance value and temperature coefficient.

For example, the platinum thin film resistance element of the present invention, which has a resistance value of 10 KΩ at 0° C. and in which the resistance ratio between 100° and 0° C. is 1.3000, has the following temperature-resistance characteristic:

| | | | |
|---|---|---|---|
| −100° C. | 6,998 Ω | +50° C. | 11,500 Ω |
| −50° C. | 8,499 Ω | +75° C. | 12,250 Ω |
| −25° C. | 9,250 Ω | +100° C. | 13,000 Ω |
| 0° C. | 10,000 Ω | +125° C. | 13,750 Ω |
| +25° C. | 10,750 Ω | +150° C. | 14,500 Ω |

Figure 3:
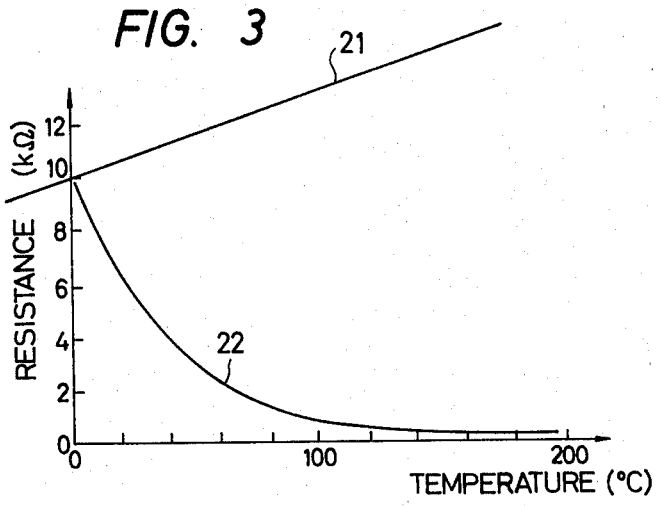
FIG. 3 is a graph showing resistance-temperature characteristics of a platinum thin film resistance element and a thermistor.

In this case, the temperature-resistance characteristic is almost linear, as indicated by the line 21 in FIG. 3. In a thermistor heretofore employed for measuring a small temperature change, a resistance variation/°C. at −25° C. and a resistance variation/°C. at 50° and 100° C. are entirely different, as is evident from the curve 22 in FIG. 3. In addition to this, because of secular change and hysteresis, the conventional thermistor is poor in reproducibility and hence is not utterly reliable and not accurate as a temperature measuring instrument. In contrast thereto, the platinum thin film resistance element has substantially the same temperature coefficient over the temperature range from <100° to 200° C., as mentioned above; accordingly, a resistance variation/°C. at any temperature within the range of −100° to 200° C. is 30Ω and it is 3.0Ω per 0.1° C. This indicates that even if the temperature coefficient slightly decreases, the resulting resistance variation remains below an error range. Such a large resistance variation could not have been taken out by a conventional 100Ω platinum resistance thermometer.

Figure 4:
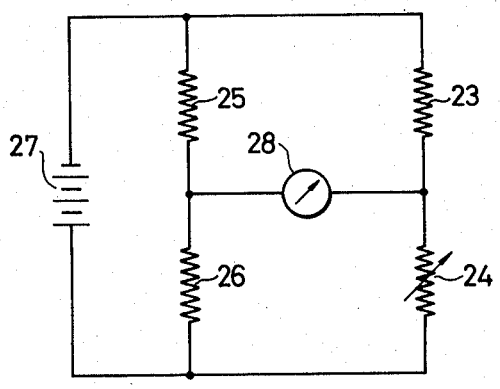
FIG. 4 is a diagram illustrating a bridge circuit for measuring a resistance variation of the platinum thin film resistance element of the present invention.

In the case of applying the platinum thin film resistance element of the present invention to a temperature measuring instrument, use in made of a bridge circuit arrangement such, for example, as shown in FIG. 4, as is the case with kind of temperature measuring instrument hitherto employed. In FIG. 4, a platinum thin film resistance element 23 and a variable resistor 24 the temperature coefficient of which is substantially zero are connected in series; a series circuit of resistors 25 and 26 is connected in parallel to the series circuit 23, 24; a power source 27 is connected across the series circuit 25, 26; an ammeter, voltmeter or like indicator is connected between the junction of the resistance element 23 and the resistor 24 and the junction of the resistors 25 and 26. The resistance value of the resistor 24 is set, for instance, to 0° C. in agreement with the resistance value of the platinum thin film resistance element 23. The resistance values of the resistors 25 and 26 are selected equal to each other. The resistor 24 is formed, for example, of a manganin wire (Cu 83 to 86%, Mn 12 to 15% and Ni 2 to 4%). The temperature coefficient of this wire is about 50 PPM in the temperature range of −100° to +200° C., and consequently, when the resistance value of the resistance element 23 is 10Ω, a resistance variation per 0.1° C. is less than 0.01Ω, which is negligible relative to the 3.0Ω resistance change of the platinum thin film resistance element 23 per 0.1° C. Thus the use of the platinum thin film resistance element of the present invention permits highly accurate temperature measurements. In the case of employing the platinum thin film resistance element for temperature measurements, the insulating substrate 11 is formed, for example, about 2.8 mm in diameter and about 10 mm long so as to provide for enhanced accuracy in the measurement.

Figure 5:
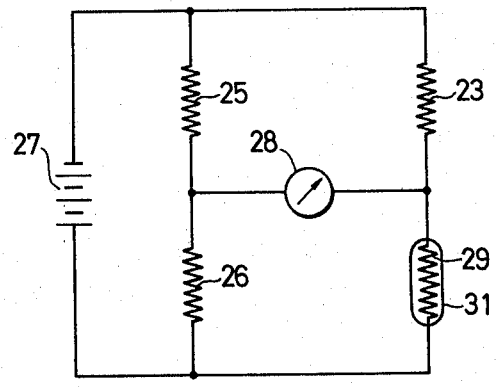
FIG. 5 is a diagram showing a circuit for measuring the gas concentration based on a difference in gas thermal conductivity, using the platinum thin film resistance element.

The present invention allows ease in the fabrication of platinum thin film resistance elements of such a high resistance value as 1 to 10Ω and of uniform characteristics, with the dispersion thereof held less than ±0.1%. Accordingly, for instance, as shown in FIG. 5, platinum thin film resistance elements 23 and 29 of the same characteristics are connected in series and a bridge circuit is formed using the resistance elements 23 and 29 and the resistors 25 and 26 as respective arms, and then the power source 27 and the indicator 28 are connected to the bridge circuit. With such a bridge circuit arrangement, it is possible to detect gas by sealing the one resistance element 29 in a gas-tight envelope 31 as of glass and disposing the other resistance element in the air at the place where it is desired to detect the arrival of a gas. The thermal conductivities of main gases are as follows:

| Gas | Thermal conductivity of gas Cal $cm^{-1}$ $sec^{-1}$(°C.) × $10^{-5}$ 0° C. | 100° C. |
|---|---|---|
| Air | 5.83 | 7.4 |
| Hydrogen | 41.6 | 54.7 |
| Oxygen | 5.8 | 7.6 |
| Methane | 7.2 | — |
| Ethane | 4.3 | 7.7 |
| Propane | 3.5 | — |
| Alcohol | 3.4 | 5.0 |
| Carbon dioxide | 2.3 | |

Accordingly, if the output from the bridge circuit is pre-adjusted to zero with the resistance element 23 in air, when the resistance element 23 comes into contact with a gas the thermal conductivity of which greatly differs from that of the air, such as, for example, hydrogen, methane, propane, carbon dioxide or the like, the surface of the resistance element 23 is cooled or heated to cause a current to flow through the ammeter 28. Thus a specified gas can be detected providing that the existence of only that gas is possible. Futhermore, under such condition since the temperature change by such cooling or heating is proportional to the gas concentration, it is also possible to measure the gas concentration by checking the gas concentration-output characteristic of the bridge circuit and calibrating the ammeter 28 in advance.

In this case, in order to improve the detection sensitivity, the platinum thin film resistance element 23 is adapted to be heated up to a certain temperature by the current flowing in the element itself. Therefore, it is desirable for the reduction of power consumption that the platinum thin film resistance element 23 be small in size and in heat capacity. For example, the insulating substrate 11 is about 1 mm in diameter and about 3 mm in length and has a resistance value of 200 to 300Ω and the voltage of the power source 27 is approximately 6 to 8 V.

Figure 6:
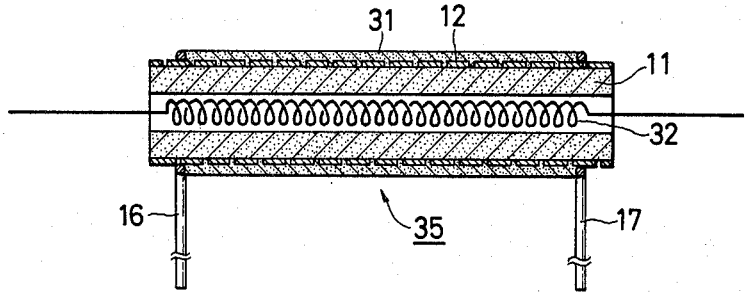
FIG. 6 is a sectional view illustrating an example of the platinum thin film resistance element of the present invention for the application to a gas sensor.
Figure 7:
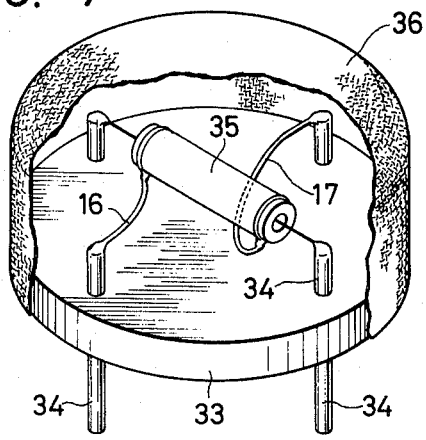
FIG. 7 is a perspective view showing the resistance element depicted in FIG. 6 mounted on a stem.

The platinum thin film resistance element of the present invention can be employed not only for the detection of a gas through utilization of a difference in thermal conductivity between the air and the gas, but also as a gas sensor which makes use of the change in heat generation depending upon an amount of gas or the kind of gas adsorbed to the surface of a metal oxide. That is, as described previously in respect to FIG. 1, the platinum thin film 12 is deposited on the insulating substrate 11 and the kerf 13 is formed in the platinum thin film 12. Then, as depicted in FIG. 6, a semiconductor oxide film 31 is uniformly deposited by high-frequency sputtering to a thickness of 1 to 2 μm over the entire area of the platinum thin film 12, while rotating the insulating substrate 11; in the alternative, the semiconductor oxide film 31 may be formed 10 to 20 μm thick by a painting method. Thereafter, the semiconductor oxide film 31 is heat-aged at 500° to 800° C. for several hours, by which the oxide film is stabilized. Finally, a heater 32 formed by a nichrome wire is inserted into the body of the cylindrical insulating substrate 11 to produce a resistance element 35. As shown in FIG. 7, the lead wires 16 and 17 and both ends of the heater 32 are respectively connected to four terminal pins 34 inserted into and fixed to a stem 33 as of steatite or bakelite and then the resistance element assembly is covered with a net cap 36. The semiconductor oxide film 31 can be made of $SnO_2$, ZnO and $V_2O_5$. The resistance value of the platinum thin film 12 is selected to range from about 100 to 500Ω.

In our experiment in which the insulating substrate 11 was 2.3 mm in diameter and 7 mm long, the resistance value of the platinum thin film 11 was 100Ω, the semiconductor oxide film 31 was formed of $SnO_2$, the bridge circuit of FIG. 4 was used, the heater 32 with a 90Ω resistance value was energized by a current of 10 mA at a voltage of 12 V, the voltage of the power source 27 was 4 V, a sensor of the and following sensitivity to methane was thereby obtained:

| $CH_4$ | 10 | 50 | 100 | 200 | 500 | 1,000 | 5,000 | 10,000 PPM |
|---|---|---|---|---|---|---|---|---|
| | 3 | 14 | 25 | 41 | 69 | 94 | 178 | 230 mV |

Drift: lower than 1 mV within 24 hr. When the methane conentration was changed from 10,000 PPM to zero, the meter 28 returned to the zero point within three minutes.

The gas sensing mechanism in this case is to detect a variation in the resistance value of the platinum thin film 12 which is caused by a temperature rise of the $SnO_2$ film 31 due to the adsorption thereto of methane. Incidentally, the resistance value $R_1$ of the platinum thin film 12 and the resistance value $R_2$ of the $SnO_2$ film 31 undergo such changes as follows:

| Temperature (°C.) | $R_1$ (Ω) | $R_2$ (KΩ) |
|---|---|---|
| 20 | 150 | 95 |
| 100 | 199 | 44 |
| 200 | 260 | 4.9 |
| 300 | 310 | 9.5 |
| 400 | 355 | 30 |

In this way, the resistance value of the $SnO_2$ film 31 also varies with the temperature change. A prior art semiconductor gas sensor detects a gas through utilization of a variation in the resistance value of the $SnO_2$ itself which is caused by the gas. The variation characteristic in this case is nonlinear. In the resistance element at the present invention, for use in the gas sensor shown in FIG. 6, the resistance value across the lead wires 16 and 17 becomes a parallel resistance value R of the resistance value $R_1$ of the platinum thin film 12 and the resistance value $R_2$ of the $SnO_2$ film 31 as follows:

$$R=(R_1\times R_2)/(R_1+R_2)$$

Figure 8:
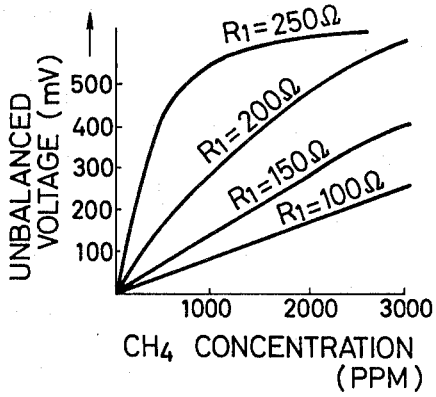
FIG. 8 is a graph showing sensitivity-methane concentration characteristics, using a resistance value $R_1$ of the platinum thin film as a parameter.
Figure 9:
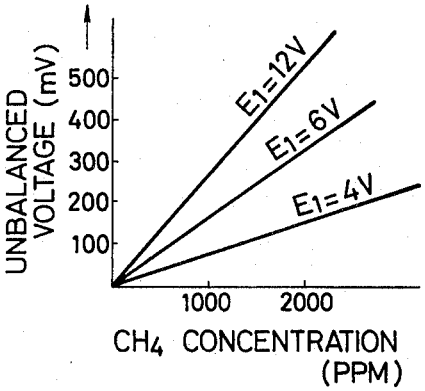
FIG. 9 is a graph showing sensitivity-methane concentration characteristics, using a bridge voltage $E_1$ as a parameter.

However, by selecting the resistance value $R_2$ to be larger than the resistance value $R_1$, for example, by two orders of magnitude, as shown in the foregoing table, so that the resistance value R across the lead wires 16 and 17 may be substantially dependent on the platinum thin film, the resistance value R can be made linear and stable. For example, in the case of the methane detecting element mentioned previously, the unbalanced voltage characteristic of the bridge circuit with respect to the methane concentration becomes nonlinear when the resistance value $R_1$ of the platinum thin film 12 used as a parameter increases up to about 250Ω, as shown in FIG. 8. As the resistance value $R_1$ decreases, the unbalanced voltage characteristic becomes linear but the sensitivity drops. Thus, by selecting the resistance value $R_2$ to be sufficiently larger than the resistance value $R_1$, the sensitivity exhibits linearity and this sensitivity rises with an increase in the voltage $E_1$ of the power source 27 of the bridge circuit, as depicted in FIG. 9.

The gas sensor employing the platinum thin film resistance element shown in FIGS. 6 and 7 has the following features:

(1) The zero point is very stable in the absence of a gas.

(2) The sensor becomes stabilized in a short time after connecting thereto the power source. (The initial stabilization characteristic is excellent.)

(3) It is possible to accurately detect methane from a low concentration of 10 PPM or so to a high concentration of 10% or more.

(4) Since a relatively large platinum thin film resistance can be used, a high voltage can also be applied to the sensor when it is incorporated in the bridge circuit and the sensor can be used with its output freely adjusted by selecting the bridge voltage $E_1$.

(5) Since a stable layer of the platinum thin film 12 underlies the semiconductor oxide thin or thick film 31, the sensor suffers no temperature loss and is capable of detecting temperature variations with high sensitivity and hence it is very excellent in response speed and in sensitivity to gas.

(6) Since the resistance of the element is designed to depend on the variation in the resistance of the platinum, the reproducibility of the gas sensitivity is also excellent.

(7) Since the gas sensitivity characteristic is also almost linear, the sensor is easy to use.

For the detection of a gas, in particular, carbon monoxide, the metal oxide semiconductor film 31 is formed of copper monoxide CuO in FIG. 6. From the viewpoints of stability, gas sensitivity and response speed, it is preferred that the CuO film 31 is formed about 1 to 0.5 μm thick by the high-frequency sputtering or painting. When the resistance elements of various values were heated up to about 200° C. by applying a current to the heater 32 and the bridge voltage $E_1$ was set to 6 V and 12 V, the bridge unbalanced voltages with respect to 50 PPM of carbon monoxide were as follows:

| Resistance value of platinum thin film | Unbalanced voltage ($E_1$ = 6 V) | Unbalanced voltage ($E_2$ = 12 V) |
|---|---|---|
| 452 Ω | 13 mV | 25 mV |
| 523 Ω | 21 mV | 42 mV |
| 871 Ω | 30 mV | 60 mV |
| 1700 Ω | 63 mV | 120 mV |

Figure 10:
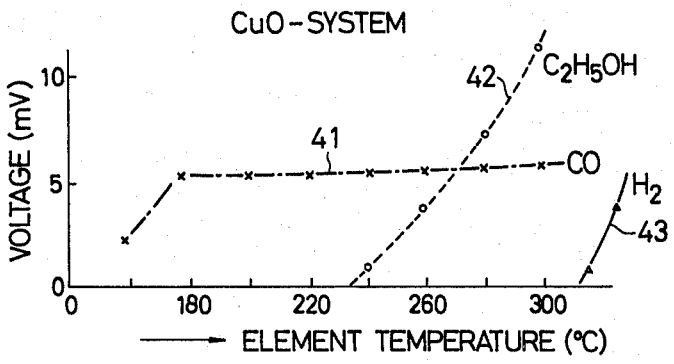
FIG. 10 is a graph showing the gas sensitivity-element temperature characteristic of the resistance element of the present invention employing a copper oxide for a semiconductor film 31.
Figure 11:
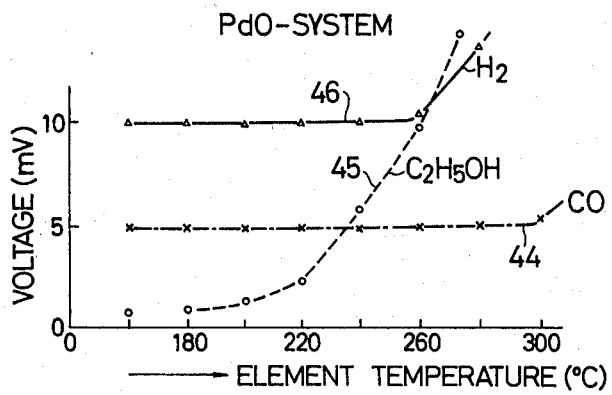
FIG. 11 PRIOR ART
FIG. 11 is a graph showing the sensitivity-element temperature characteristic of a conventional PdO-system gas sensor.
Figure 12:
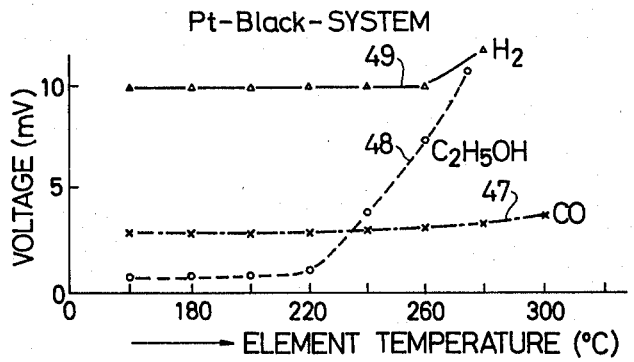
FIG. 12 PRIOR ART
FIG. 12 is a graph showing the sensitivity-element temperature characteristic of a conventional platinum black system gas sensor.

The sensor provides large outputs in response to carbon monoxide of low concentration and is sensitive only to carbon monoxide. That is, with this resistance element, the sensitivities to carbon monoxide, methyl alcohol and hydrogen are respectively such as indicated by curves 41, 42 and 43 in FIG. 10 and, by heating the resistance element below 240° C., it is possible to detect carbon monoxide alone. With a conventional sensor of the type using a lead oxide for the semiconductor film 31, the sensitivities to carbon monoxide, alcohol and hydrogen are respectively such as indicated by curves 44, 45 and 46 in FIG. 11 and, in this case, even if the element temperature is suitably selected, it is impossible to detect carbon monoxide and hydrogen independently of each other. Further, in the case of a conventional sensor of the type using platinum black for the semiconductor film 31, the sensitivities to carbon monoxide, alcohol and hydrogen are respectively such as indicated by curves 47, 48 and 49 in FIG. 12 and these gases cannot be detected separately. The sensitivities shown in FIGS. 10, 11 and 12 were measured in the case of the concentration of each gas being 500 PPM.

By a suitable selection of the metal oxide for the semiconductor film 31, the resistance element of FIG. 6 can be employed for detecting a nitrogen oxide gas. In this case, 10 to 30 wt% of a rare earth oxide (for example, samarium trioxide $Sm_2O_3$) and 0.5 to 5 wt% of silver nitrate $AgNO_3$ are added to vanadium pentoxide $V_2O_5$ and the mixture is sufficiently kneaded with pure water into a paste. The paste, after being dried, is pulverized and baked in a crucible at 500° to 550° C. for more than two hours, thus obtaining a semiconductor powder. The semiconductor powder thus obtained is deposited by high-frequency sputtering, or coated by the aforementioned painting method, on the platinum thin film 12. In our experiment, such semiconductor films were sufficiently heat-aged at 400° to 500° C. and further subjected to electrical aging for four to seven days. When the resistance elements were heated up to 300° to 320° C. and the bridge voltage $E_1$ was 6 V, the sensitivities to an NO gas were as follows:

| Resistance of platinum thin film (Ω) | Thickness of semiconductor film 31 | Unbalanced voltage (mV) 20 PPM | 40 PPM |
|---|---|---|---|
| 150 | thick | 8 | 15 |
| 200 | thick | 15 | 29 |
| 300 | thick | 18 | 34 |
| 150 | thin | 24 | 45 |
| 220 | thin | 35 | 68 |
| 350 | thin | 42 | 80 |

In the case where the rare earth oxide is 0%, the resistance element is insensitive to NO but sensitive to $NO_2$ alone. As nitrogen oxide gas sensors, there have been known those of the types using $V_2O_5$-Ag and phthalocyanine-copper systems; though capable of detecting the $NO_2$ gas, they are not stable and their sensitivity to NO is not sufficient. In contrast thereto, the platinum thin film resistance element permits the detection of low-concentration NO gas, too.

Further, for the detection of ammonia, the semiconductor film 31 of the resistance element of FIG. 6 was formed using a mixture of 3 to 10 wt% of $Sm_2O_3$, 1 to 5 wt% of $Sb_2O_3$ and 0.5 to 5 wt% of $AgNO_3$ with respect to $V_2O_5$. As shown in the following table, this element is excellent in that it is several times higher in sensitivity to ammonia than conventional ammonia detecting elements and is almost insensitive to perfume and ethyl alcohol.

| | $NH_3$ 40 PPM | Perfume | $C_2H_5OH$ 100 PPM |
|---|---|---|---|
| $SnO_2$ system semiconductor (for ammonia) | 10 mV | 36 mV | 42 mV |
| $SnO_2$—Pd semiconductor (for methane) | 3 | 5 | 12 |
| $V_2O_5$—Ag semiconductor (for $NO_2$) | 18 | 15 | 26 |
| ZnO system semiconductor | 4 | 12 | 18 |
| Element of this invention | 35 | 0 | 2 |

When $Sb_2O_3$is out of the range from 1 to 5%, the sensitivity to ammonia abruptly lowers.

Figure 13:
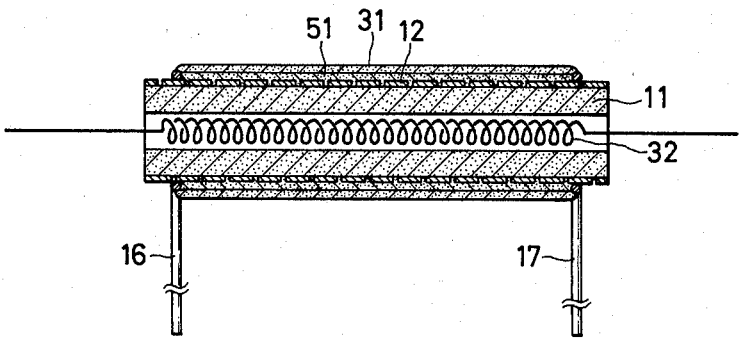
FIG. 13 is a sectional view illustrating another example of the platinum thin film resistance element of the present invention for the application to a gas sensor.

As described above, the resistance element having the metal oxide semiconductor film 31 formed on the platinum thin film 12 can be employed for the detection of a specified gas according to the material used for the formation of the semiconductor film 31. Variations in the characteristics of such an element can markedly be reduced, for instance, by forming a protective layer 51 of alumina cement or beryllia cement on the platinum thin film 12 and, further, forming the semiconductor film 31 on the protective layer 51, as shown in FIG. 13. For example, in the case of the resistance element having the semiconductor film 31 of the $SnO_2$ system formed directly on the platinum thin film 12, the resistance value increased about 10 to 15% when the element was held at 400° C. for seven days, whereas, in the case of the resistance element having the protective layer 51, no resistance variations were observed when the element was held at 400° C. for 20 days. This is considered due to the fact that the protective layer 51 prevents diffusion of the platinum from the thin film 12 into the semiconductor film 31 (or vice versa). Moreover, by the provision of such a protective layer 51, it is possible to specify the gas to which the resistance element is sensitive. The gas sensitivity of various elements is as follows:

| | $CH_4$ 0.1% | $iC_4H_{10}$ 0.1% | $H_2$ 0.1% | $C_2H_5OH$ 0.1% | CO 0.02% |
|---|---|---|---|---|---|
| Pt—$SnO_2$ | 15~30 | 40~140 | 80~150 | 40~80 | 5~15 mV |
| Pt—alumina cement-$SnO_2$ | 10~20 | 40~80 | 40~70 | 0~3 | 0~1 |
| Pt—beryllia cement-$SnO_2$ | 8~10 | 11~16 | 20~25 | 0~1 | 0~1 |
| Pt—$SiO_2$—$SnO_2$ | 15~30 | 40~140 | 80~150 | 40~80 | 5~15 |

As will be understood from the above table, by combining the $SnO_2$ film 31 with the beryllia cement layer 51 and the alumina cement layer 51, respectively, there can be obtained resistance elements which are almost insensitive to alcohol and smoke but sensitive mainly to inflammable gases, that is, natural gas, coke gas, propane gas and so forth.

Figure 14:
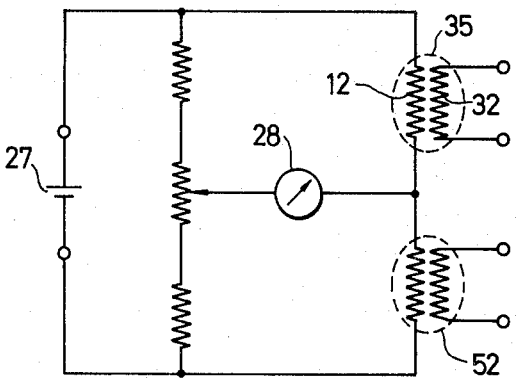
FIGS. 14 and 15 are diagrams illustrating examples of a temperature compensated bridge circuit for gas detection.
Figure 15:
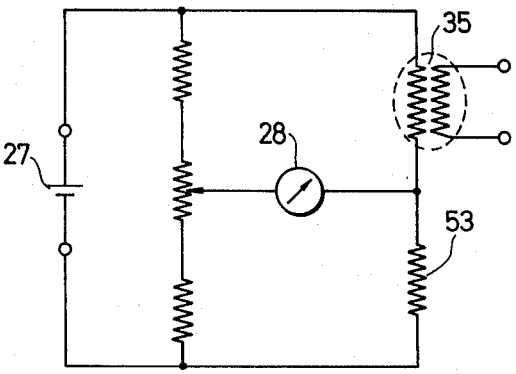

In the gas sensors of the type utilizing the resistance variation, a temperature compensating element is usually employed for avoiding the influence of ambient temperature. To this end, in the case of sensing a gas by the element 35 having the metal oxide semiconductor film 31, use is made of a bridge circuit such as shown in FIG. 14 which employs, in addition to the element 35, a temperature compensating element 52 which is identical in characteristics with the element 35 except that it is insensitive to the gas. For increasing the sensitivity, a current is applied to the heater 32 of the element 35 to heat it, for example, up to 150° to 450° C. for burning the gas; in this case, a current is also applied to the heater of the temperature compensating element 52 to heat it up to the same temperature as the element 35. In such a case, power consumption is increased by the heaters 32 of the two elements 35 and 52. But in the case where a platinum thin film resistance element 53 with no heater is used as the temperature compensating element and a platinum thin film having a resistance value, for example, 150Ω at 20° C. is used as the element 35 at 350° C. to provide a resistance value of 300Ω as shown in FIG. 15, the resistance value of the platinum thin film resistance element 53 is selected to be equal, at room temperature, to the resistance value of the element 35 at the working temperature, i.e. 300Ω in this example. According to this arrangement, temperature is sufficiently compensated by the platinum thin film resistance element 53 for compensation use; furthermore, since no heater is needed for the temperature compensation, power consumption is small.

In the foregoing, the insulating substrate 11 need not always be cylindrical but may be plate-shaped, too.

It will be apparent that many modifications and variations may be effected without departing from the scope of the novel concepts of this invention.

What is claimed is:

1. A gas sensor comprising a platinum thin film resistance element which includes:

an insulating substrate having a smooth surface the unevenness of which is less than 1.1 μm;

a substantially pure platinum thin film formed as a continuous, solid film to a thickness of 100 to 1000 Å on said surface of the insulating substrate, the resistance value of said thin film being stabilized by sputtering platinum particles forming said film onto said surface and by thereafter heat aging said film at temperatures from about 100° C. to about 1000° C. in a step-wise manner, said film having a kerf formed therein to increase its resistance value;

a metal oxide semiconductor film formed on the platinum thin film to adsorb a gas to be sensed; and a pair of lead wires electrically connected to opposite end portions of the platinum thin film and fixed to the insulating substrate.

2. A gas sensor according to claim 1 wherein the resistance value of the metal oxide semiconductor film is significantly larger than the resistance value of the platinum thin film.

3. A gas sensor according to claim 1 wherein a protective layer is interposed between the platinum thin film and the metal oxide semiconductor film to prevent the diffusion therethrough of components of the two films.

4. A gas sensor according to claim 3 wherein the protective layer is formed of alumina cement.

5. A gas sensor according to claim 3 wherein the protective layer is formed of beryllium cement.

6. A gas sensor according to claim 1 or 3 wherein means is provided for electrically heating the insulating substrate.

7. A gas sensor according to any one of claims 1 or 2 to 5 wherein the metal oxide semiconductor film is operative to adsorb and release an inflammable gas.

8. A gas sensor according to any one of claims 1 or 2 to 5 wherein the metal oxide semiconductor film is formed of copper oxide.

9. A gas sensor according to any one of claims 1 or 2 to 5 wherein the metal oxide semiconductor film is formed of a mixture including 10 to 30 wt% of an oxide of a rare earth and 0.5 to 5 wt% of silver nitrate $AgNO_3$ with respect to vanadium pentoxide $V_2O_5$.

10. A gas sensor according to any one of claims 1 or 2 to 5 wherein the metal oxide semiconductor film is formed of a mixture including 3 to 10 wt% of samarium pentoxide $SmO_5$, 1 to 5 wt% of antimony trioxide $Sb_2O_3$ and 0.5 to 5 wt% of silver nitrate with respect to vanadium pentoxide $V_2O_5$.

* * * * *